United States Patent [19]

Cardinal et al.

[11] 4,314,230

[45] Feb. 2, 1982

[54] DEVICES COMPRISING CONDUCTIVE POLYMERS

[75] Inventors: Raymond F. Cardinal, Fremont; Jack M. Walker, Portola Valley, both of Calif.

[73] Assignee: Raychem Corporation, Menlo Park, Calif.

[21] Appl. No.: 174,136

[22] Filed: Jul. 31, 1980

[51] Int. Cl.[3] ..... H01C 1/012

[52] U.S. Cl. ..... 338/314; 338/25; 338/328; 338/329; 338/308

[58] Field of Search ..... 338/328, 212, 322, 314, 338/320, 323, 324, 327, 329, 307–309; 252/54; 29/611, 612, 610; 219/543, 548, 549, 212, 210, 505, 510; 427/103, 123–126; 156/272, 292

[56] References Cited

U.S. PATENT DOCUMENTS

| | | | |
|---|---|---|---|
| 2,724,658 | 11/1955 | Lytle | 219/543 X |
| 3,023,390 | 2/1962 | Moratis et al. . | |
| 3,061,501 | 10/1962 | Dittman et al. | 219/543 X |
| 3,221,145 | 11/1965 | Hager, Jr. | 219/543 X |
| 3,287,684 | 11/1966 | Armbruster, Jr. | 219/543 X |
| 3,385,959 | 5/1968 | Ames et al. | 219/212 X |
| 3,413,442 | 11/1968 | Buiting et al. | 219/548 X |
| 3,676,211 | 7/1972 | Kourtesis et al. | |
| 3,811,934 | 5/1974 | Glaser | 219/543 |

OTHER PUBLICATIONS

"The Metco Flame Spraying Processes", Metco Inc., Westbury, N.Y. Bulletin 136C, 1967.

*Primary Examiner*—C. L. Albritton
*Attorney, Agent, or Firm*—Lyon & Lyon

[57] ABSTRACT

Electrical devices comprise a conductive polymer element and, in electrical contact therewith, a flame-sprayed layer of a metal or other highly conductive material. Electrical leads can readily be attached to the flame-sprayed layer. Particularly valuable devices are those in which at least part of the conductive polymer element is a PTC or NTC conductive polymer. The flame-sprayed layer can be formed directly by flame-spraying a suitable material onto the device, or by flame-spraying the material onto a carrier and then laminating the layer, on the carrier, to the device.

43 Claims, 2 Drawing Figures

DEVICES COMPRISING CONDUCTIVE POLYMERS

BACKGROUND OF THE INVENTION

1. Field of the Invention

This invention relates to electrical devices comprising conductive polymers, and in particular to the provision in such devices of highly conductive layers to which electrical leads can readily be attached.

2. Summary of the Prior Art

Conductive polymer compositions [including such compositions which exhibit positive temperature coefficient (PTC) or negative temperature coefficient (NTC) behavior] and electrical devices comprising them, are known. Reference may be made for example of U.S. Pat. Nos. 2,978,665 (Vernet et al), 3,243,753 (Kohler), 3,311,862 (Rees), 3,351,882 (Kohler et al), 4,017,715 (Whitney et al), 4,085,286 (Horsma et al), 4,095,044 (Horsma et al), 4,177,376 (Horsma et al) and 4,177,446 (Diaz) and to copending and commonly assigned applications Ser. Nos. 818,711 (Horsma et al), 963,372 (Horsma), 965,343, now U.S. Pat. No. 4,237,441, (Van Konynenburg et al), 965,344, now U.S. Pat. No. 4,238,812, (Middleman et al), 969,928 (Van Konynenburg et al), 6,773 (Simon), 38,218 (Middleman et al), 41,071 (Walker) and the continuation-in-part thereof filed July 10, 1980, 75,413 (Van Konynenburg), 84,352 (Horsma et al), 85,679 (Toy et al), 88,344 (Lutz), 98,711 (Middleman et al), 98,712 (Middleman et al), 102,576 (Brigham), the application filed by Brigham on Dec. 7, 1979, now Ser. No. 102,621, 134,354 (Lutz), 141,984 (Gotcher et al), 141,987 (Middleman et al), 141,988 (Fouts et al), 141,989 (Evans), 141,990 (Walty), 141,991 (Fouts et al), 142,053 (Middleman et al), and 142,054 (Middleman et al). The disclosure of each of these patents and patent applications is incorporated herein by reference. The term "conductive polymer" composition is used herein to denote a composition which has a resistivity of less than $10^6$ ohm.cm at a temperature between 0° C. and 200° C., preferably at 25° C.

In many such devices, current is passed through the conductive polymer by means of laminar electrodes, and the electrical leads to the remainder of the circuit are attached to the electrodes. The electrodes are generally composed of a material having a resistivity of at most $5\times10^{-2}$ ohm.cm, preferably a metal, and may be (but are not necessarily) of a thickness such that all points on any particular electrode are at the same potential. When the devices are subject to temperature cycling, differences between the thermal coefficients of expansion of the electrode materials and the conductive polymers tend to result in separation of the electrode from the conductive polymer element. This is of course highly undesirable. The problem is particularly severe when the conductive polymer element comprises a PTC or NTC conductive polymer element, since the PTC or NTC effect depends upon a change in the volume of the PTC or NTC element. It is, therefore, preferred to use an electrode which can expand and contract with the conductive polymer, especially an electrode having a plurality of apertures therein e.g. a metal mesh or grid, the apertures of the electrode preferably being of a size such that the conductive polymer can penetrate into the apertures and anchor the electrode and the conductive polymer to each other. Unfortunately, however, there are serious problems in securing electrical leads to these preferred electrodes. Thus it is unsatisfactory to solder or weld the lead to a portion of the electrode which is contacted by the conductive polymer, inter alia because the soldering or welding process degrades the polymer. This can be avoided by soldering the lead to a portion of the electrode which extends beyond the edge of the conductive polymer; but this leads to a device of greater size and to waste of electrode material, and severely restricts the range of manufacturing techniques.

One method of attaching a lead to a portion of a laminar apertured electrode which is in contact with a conductive polymer is described in Application Ser. No. 141,990 (Walty). The leads are attached, e.g. by soldering, to an apertured conductor, which is then bonded by means of a conductive adhesive to an area of the electrode which is contacted by the conductive polymer; a layer of polymeric material is then placed over the conductor and penetrates through the openings thereof to contact and bond to the conductive polymer. Although this is a very useful technique, it is somewhat inconvenient and expensive and does not give a satisfactory result for all purposes.

As described in detail below, the present invention makes use of flame-sprayed layers of metal or other highly conductive material as a means for making electrical contact with conductive polymer elements. The term "flame-spraying" is used in this specification to denote any process in which a material is brought to its melting point and sprayed onto a surface to produce a coating. Thus the term includes the processes which are known in the art as the metallizing, "Thermospray" and plasma flame processes, as described for example in 1967 Bulletin 136C and other publications of Metco Inc., Westbury, N.Y. In the metallizing process, a metal wire is melted in an oxygen-fuel-gas flame and atomized by a compressed air blast which carries the metal particles to the surface. The "Thermospray" process is similar except that the material is supplied as a powder and may be a metal or non-metal. The plasma flame process is similar to the "Thermospray" process, but makes use of a plasma of ionized gas to melt the powdered material and convey it to the surface. Flame-sprayed coatings have been used for a wide variety of purposes, including the provision of solderable electrical connections to carbon resistors and brushes and to ceramic materials, including PTC ceramics used in thermistors, such as barium titanates ]see the 1967 Metco Bulletin 136C, U.S. Pat. No. 3,023,390 (Moratis et al) and U.S. Pat. No. 3,676,211 (Kourtesis et al)]. Moratis et al flame-spray an alloy containing 40–55% silver, 20–30% cadmium, 10–20% zinc and 10–20% copper, and according to Kourtesis et al, that procedure "while resulting in an acceptable ohmic contact, is prohibitively expensive because of the high silver content of the alloy and results in a contact having an insufficient bond between the alloy and the ceramic". Kourtesis et al. teach that the ceramic material must be preheated to a temperature of 450°–525° F. before being flame-sprayed, in order to minimize thermal shock problems. Flame-sprayed metal layers have also been used to provide electromagnetic shielding on the surfaces of cabinets made of insulating polymeric materials.

SUMMARY OF THE INVENTION

We have now discovered that if a metal (or other material which has a resistivity of at most $5\times10^{-2}$ ohm.cm) is flame-sprayed against a surface of a device comprising a conductive polymer element, thus forming a layer which is at least 1 mil thick and is in electrical contact with the conductive polymer element, the resulting flame-sprayed layer is one to which an electrical lead can readily be attached by soldering (or otherwise) and which can maintain excellent physical and electrical contact with the device even when subject to temperature cycling. Similarly valuable results can be obtained by forming such a flame-sprayed layer on a suitable carrier member and then laminating the layer to the device.

In one aspect, the invention provides an electrical device which comprises an element composed of a conductive polymer composition and, in electrical contact therewith, a flame-sprayed layer of a material which at 25° C. has a resistivity of at most $5\times10^{-2}$ ohm.cm, said layer being at least 1 mil thick.

In another aspect the invention provides a method of providing a highly conductive layer on a surface of a device which comprises an element composed of a conductive polymer composition, which method comprises flame-spraying onto a surface of the device a material which at 25° C. has a resistivity of at most $5\times10^{-2}$ ohm.cm, to form a layer of said material which is in electrical contact with said element.

In a further aspect the invention provides a method of providing a highly conductive layer on a surface of a device which comprises an element composed of a conductive polymer composition, which method comprises (a) flame-spraying, onto the surface of a carrier member, a material which at 25° C. has a resistivity of at most $5\times10^{-2}$ ohm.cm, to form a layer of said material which is at least 1 mil thick; and (b) contacting said flame-sprayed layer, on said carrier member, and a surface of said device, under conditions of heat and pressure, to form a layer of said material which is in electrical contact with said element.

BRIEF DESCRIPTION OF THE DRAWINGS

The invention is illustrated in the accompanying drawings, in which.

DETAILED DESCRIPTION OF THE INVENTION

Figure 1:
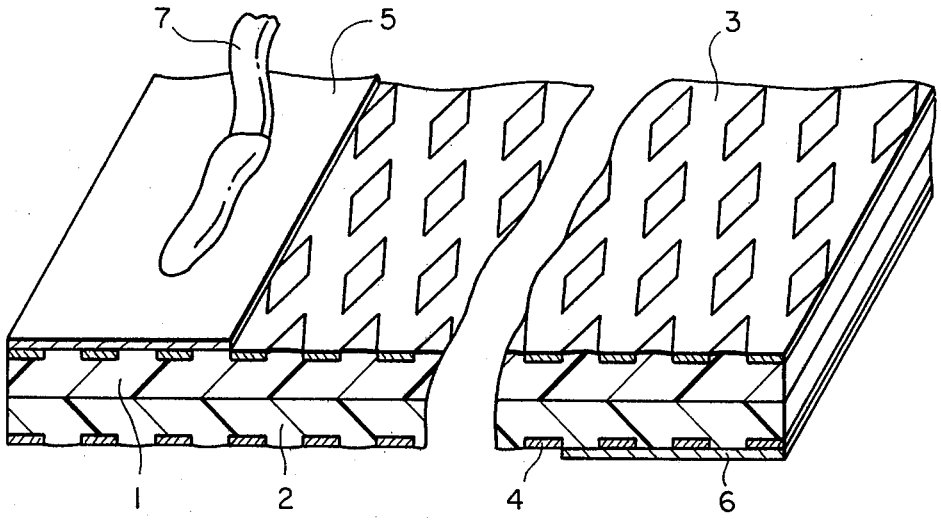
FIGS. 1 and 2 illustrate devices of the invention.

The flame-sprayed layer is composed of a material having a resistivity of at most $5\times10^{-2}$ ohm.cm, preferably at most $10^{-4}$ ohm.cm, and has a thickness of at least 1 mil, preferably at least 2 mil, especially at least 3 mil, e.g. 3 to 20 mil. Preferred materials are metals (including alloys), e.g. tin or Babbit metal (an alloy of tin, about 90%, lead, antimony and copper). However, other flame-sprayed conductive materials, e.g. carbon, can be used. A first flame-sprayed layer can be covered, in whole or in part, with a second flame-sprayed layer of the same or a different conductive material or with a second conductive layer applied by some other means such as plating. Where electrical contact with the layer is to be made by means of leads soldered or welded thereto, then the layer should be composed of a solderable or weldable material or at least partly covered by a layer of solderable or weldable material. Where the flame-sprayed layer is in direct contact with conductive polymer, it preferably contains less than 5%, especially substantially 0%, of copper.

The conductive polymer element (often referred to herein as a CP element) in the devices of the invention preferably comprises a PTC or NTC element composed of a conductive polymer composition which exhibits PTC or NTC behavior. For example the CP element may consist essentially of a laminar PTC element with a laminar electrode on each face thereof, as for example in a circuit control device; alternatively the CP element may comprise a laminar PTC element with a laminar CW element laminated to one or each face thereof, (as for example in a heater), the CW element being composed of a ZTC conductive polymer. Often the conductive polymer will be cross-linked. Devices of this kind are described in the prior art referred to above.

The flame-sprayed layer is preferably in direct physical contact with the CP element. In many cases there will be a foraminous element at the interface between the flame-sprayed layer and the CP element, with the conductive polymer in interstices of the foraminous element. The term "foraminous element" is used herein in a broad sense to denote any element having interstices therein. The foraminous element may be self-supporting, e.g. a grid, mesh, woven fabric or non-woven fabric, or may comprise a plurality of individual members, e.g. fibers, particles or flakes, which are not interconnected (though they can of course touch). The foraminous element may be composed of conductive members, e.g. members which are composed of, or have a coating of, a material having a resistivity of at most $5\times10^{-2}$ ohm.cm, preferably at most $10^{-4}$ ohm.cm. The invention is of particular value when the foraminous element is a metal mesh (or grid) which is embedded in the conductive polymer, in which case the flame-sprayed layer and the mesh together form an electrode through which current can be passed to the CP element; generally the layer will cover only a part, e.g. a marginal portion, of the mesh. Alternatively the foraminous element may be composed of electrically insulating members; for example it may be composed of a woven or non-woven web of glass fibers, as disclosed in the Brigham applications referenced above.

The devices of the invention will generally comprise at least two electrodes which can be connected to a source of electrical power and which when so connected cause current to pass through the CP element, at least a part of at least one of the electrodes (and preferably at least a part of each of the electrodes) being a flame-sprayed layer.

The device may include electrical leads which are permanently secured to the flame-sprayed layers, for example by a soldered, welded, plated or crimped connection. Alternatively electrical connection to the flame-sprayed layer can be made by spring clips.

The preferred method of forming the flame-sprayed layer comprises flame-spraying the conductive material directly onto the device, preferably onto a surface thereof which is at least partly provided by the CP element. The device is preferably at ambient temperature when it is flame-sprayed, and if it is heated, its temperature is preferably at least 25° C., particularly at least 50° C., below the melting point of the lowest melting polymer in the CP element. Surprisingly we have found that when the molten droplets of the material strike the conductive polymer, they do not cause deleterious degradation thereof. The precise nature of the interface between the flame-sprayed layer and the conductive polymer appears to depend in part upon the melting point of the polymer. We have found that when a metal is flame-sprayed onto a surface provided in part by conductive polymer and in part by a metal mesh embedded therein, the flame-sprayed material is tenaciously bonded to that surface, forming a layer which has low contact resistance and which does not deteriorate when subject to temperature cycling. When the material is flame-sprayed onto a surface which consists essentially of a conductive polymer, it is preferred to subject the flame-sprayed layer to a hot pressing treatment to reduce the contact resistance between them.

An alternative method for forming the flame-sprayed layer on the device is to flame-spray the conductive material onto a suitable carrier member, e.g. a polymeric film, and then to contact the flame-sprayed layer, on the carrier member, and a surface of the device, under conditions of heat and pressure, thus laminating the layer and carrier member to the device. The carrier member can be an electrical insulator, so that the device is electrically insulated at the same time as the flame-sprayed lyer is formed thereon.

FIG. 1 shows, partly in cross-section, a heater in accordance with the invention. A layer 1 of a PTC conductive polymer is laminated to a layer 2 of a ZTC conductive polymer. Metal mesh 3 is embedded in the upper surface of layer 1 and metal mesh 4 is embedded in the lower surface of layer 2. The conductive polymer protrudes slightly above the surface of the mesh except at marginal portions which have been scraped and cleaned to provide flat surfaces on which metal layers 5 and 6 have been formed by flame-spraying a metal. Electrical leads have been soldered to the flame-sprayed layers 5 and 6, only electrical lead 7 being shown in the Figure.

Figure 2:
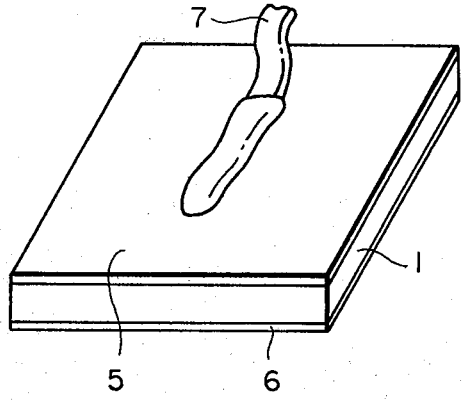

FIG. 2 shows a circuit control device in accordance with the invention. A laminar PTC conductive polymer element 1 has flame-sprayed metal layers 5 and 6 on opposite faces thereof. Electrical leads have been soldered to the flame-sprayed layers 5 and 6, only electrical lead 7 being shown in the Figure.

Although not shown in the Figures, the devices of the invention will generally have an insulating jacket.

The invention is illustrated by the following Examples, in which the percentages are by weight.

EXAMPLE 1

A heater as illustrated in FIG. 1 was prepared by the following procedure.

Following the procedure described in detail in the Example of Application Ser. No. 141,990 (Walty), a ZTC sheet material and a PTC sheet material, both 0.021 inch thick, were prepared. The ZTC sheet comprised a carbon black (Raven 8000), 7.6%, and an inert filler (glass beads), 65.9%, dispersed in a mixture of high density polyethylenes (Marlex 6003, 10.7%, and Alathon 7050, 15%). The PTC sheet comprised a carbon black (Furnex N765), 29.6%, dispersed in a high density polyethylene (Marlex 6003) 68.1%.

Rectangles 8.75×9 inch were cut from the ZTC sheet material and from the PTC sheet material, and dried under vacuum at 60° C. for 9 hours. Two rectangles 8×9 inch were cut from a sheet of fully annealed nickel mesh that had been thoroughly cleaned. The rectangles were sprayed until the nickel was completely covered, but the mesh apertures were not filled, with a composition containing 60 parts by weight of methyl ethyl ketone and 40 parts of a mixture of 80 parts by volume of Electrodag 502. The coated mesh rectangles were dried under vacuum for 2 hours at 100° C.

The PTC, ZTC and mesh rectangles were laminated to each other by layering a fluoroglass sheet (a release sheet of a glass-fiber reinforced fluorinated polymer), a mesh electrode, a PTC layer, a ZTC layer, another mesh electrode, and another fluoroglass sheet in a mold and pressing with a 12 inch press with plate temperatures of 224° C. (top) and 218° C. (bottom), for 3.5 minutes at 14 tons ram pressure. The mold was then cooled in an 18 inch cold press with air cooling at 14 tons ram pressure for 5 minutes. The laminate was annealed and then irradiated to 18–22 Mrad. Following radiation, the laminate was again annealed.

The resulting heater blank was masked, leaving 1.0 inch at each end unmasked. A razor was used to scrape away PTC or ZTC material (which had been pressed through the coated mesh) from the mesh on opposite sides of the heater in the unmasked area. The scraped area on each side of the heater blank was then further abraded with a grit blaster, and the area was cleaned of grit with methanol. Using a 0.25% Pb, 3.5% Cu, 7.5% Sb, and 88.75% Sn wire, a 0.003 to 0.005 inch thick metal film was flame-sprayed onto the clean, unmasked areas of the heater blank. Pre-tinned flat Cu leads were soldered onto the metal film. Each side of the heater blank was covered with a 8.75×9×0.015 inch polyethylene sheet which had been prepared by flame-treating with a propane torch and, while warm, spraying on one side with a 10-mil coating of a proprietary epoxy composition, then drying in a vacuum chamber at room temperature for 4–24 hours. With a polyethylene gasket surrounding the heater blank and fluoroglass release sheets covering the polyethylene jackets, the heater was placed between semi-rigid silicone rubber spacers and inserted into a stack for isothermal heat treatment at 125° C. for ~ 60 minutes. This step cured the epoxy, securing the jacket to the heater blank.

EXAMPLE 2

The ingredients shown in the Table below were mixed in a Banbury mixer, extruded into a water bath through a pelletising die, and chopped into pellets. The pellets were dried and then compression molded into a plaque about 10 mils thick. The plaque was irradiated to 20 Mrad, flame-sprayed on both sides with a coating about 4 mils thick of Babbitt metal (0.25% Pb, 3.5% cu, 7.5% Sb and 88.75% Sn) and then cut into 1×1 cm. squares. A 20 AWG Sn-plated Cu wire was soldered into each side of the square.

TABLE

| | wt | wt % | vol % |
|---|---|---|---|
| EEA 455 | 4687 g | 29.7 | 38.3 |
| Marlex 6003 | 3756 g | 23.8 | 29.7 |
| Furnex N765 | 7022 g | 44.5 | 29.7 |
| Antioxidant | 316 g | 2.0 | 2.3 |

EAA 455 (available from Dow Chemical) is a copolymer of ethylene and acrylic acid Marlex 6003 (available from Phillips Petroleum) is a high density polyethylene with a melt index of 0.3

Furnex N765 (available form City Services Co.) is a carbon black with a particle size of 60 millimicrons and a surface area of 32 $m^2/g$ The antioxidant used was an oligomer of 4,4-thio bis (3-methyl-6-t-butyl phenol) with an average degree of polymerization of 3–4, as described in U.S. Pat. No. 3,986,981

We claim:

1. An electrical device which comprises (1) an element composed of a conductive polymer composition;

(2) a flame-sprayed layer of a material which at 25° C. has a resistivity of at most $5\times10^{-2}$ ohm.cm, said layer being at least one mil thick; and (3) a foraminous element at the interface between said conductive polymer element (1) and said flame-sprayed layer (2); there being electrical and direct physical contact between said conductive polymer element (1) and said flame-sprayed layer (2) in interstices of said foraminous element (2).

2. A device according to claim 1 in which said element (1) comprises an element composed of a conductive polymer composition which exhibits resistivity/-temperature behavior selected from the group consisting of PTC behavior and NTC behavior.

3. A device according to claim 2 wherein said flame-sprayed layer (2) is in direct physical contact with an element (1) composed of a conductive polymer composition which exhibits PTC behavior.

4. A device according to claim 3 wherein said foraminous element is electrically conducting.

5. A device according to claim 4 wherein said foraminous element is a metal mesh.

6. A device according to claim 3 wherein said foraminous element is composed of an electrically insulating material.

7. A device according to claim 3 wherein said foraminous element comprises glass fibers.

8. A device according to claim 1 wherein said flame-sprayed layer is composed of a metal.

9. A device according to claim 6 wherein said flame-sprayed metal layer is at least 3 mils thick.

10. A device according to claim 9 wherein said flame-sprayed metal layer is 3 to 20 mils thick.

11. A device according to claim 9 which further comprises an electrical lead which is soldered or welded to said flame-sprayed metal layer.

12. A device according to claim 1 which further comprises an electrical lead which is attached to said flame-sprayed layer.

13. A device according to claim 1 which comprises at least two electrodes which can be connected to a source of electical power and which when so connected cause current to pass through said conductive polymer element, at least a part of at least one of said electrodes being a said flame-sprayed layer.

14. A device according to claim 13 wherein at least a part of each of said electrodes is a said flame-sprayed layer.

15. A device according to claim 14 wherein each of said flame-sprayed layers is composed of a metal, is 3 to 20 mils thick and has an electrical lead attached thereto.

16. A device according to claim 14 wherein each of said electrodes consists essentially of a said flame-sprayed layer.

17. A device according to claim 16 in which said element consists essentially of a laminar PTC element which is composed of a conductive polymer composition exhibiting PTC behavior and which has a said electrode in direct physical contact with each face thereof.

18. A device according to claim 15 wherein said flame-sprayed layer is in direct physical contact with part only of the surface of said foraminous element which is remote from said conductive polymer element.

19. A device according to claim 18 wherein said conductive polymer element comprises (a) a laminar PTC element which is composed of a conductive polymer composition exhibiting PTC behavior, and (b) a laminar CW element which is composed of a conductive polymer composition exhibiting ZTC behavior, said PTC and CW elements having a common interface.

20. A device according to claim 19 wherein one of said electrodes is in direct physical contact with the face of said PTC element opposite said common interface and another of said electrodes is in direct physical contact with the face of said CW element opposite said common interface.

21. A device according to claim 20 wherein each of said flame-sprayed layers is composed of a metal, is 3 to 20 mils thick and has an electrical lead soldered or welded thereto.

22. A device according to claim 19 in which said conductive polymer element further comprises a second laminar CW element which is composed of a conductive polymer composition exhibiting ZTC behavior, said second CW element having a common interface with said PTC element.

23. A device according to claim 22 wherein one of said electrodes is in direct physical contact with the face of one of said CW elements opposite its common interface with the PTC element and another of said electrodes is in direct physical contact with the face of the other of said CW elements opposite its common interface with the PTC element.

24. A device according to claim 23 wherein each of said flame-sprayed layers is composed of a metal, is 3 to 20 mils thick and has an electrical lead soldered or welded thereto.

25. A method of providing a highly conductive layer on a surface of a device which comprises an element composed of a conductive polymer composition and a foraminous element, said surface being provided by the foraminous element and by the conductive polymer composition in interstices of the foraminous element, which method comprises flame-spraying onto the surface of the device a material which at 25° C. has a resistivity of at most $5\times10^{-2}$ ohm.cm, to form a layer of said material which is in electrical contact and in direct physical contact with said element.

26. A method according to claim 25 wherein said layer is composed of metal and is 3 to 20 mils thick.

27. A method according to claim 25 wherein said device comprises an element composed of a conductive polymer composition which exhibits resistivity-temperature behavior selected from the group consisting of PTC behavior and NTC behavior.

28. A method according to claim 27 wherein said material is flame-sprayed onto a surface which is at least partly composed of a PTC conductive polymer composition.

29. A method according to claim 28 wherein said foraminous element is electrically conducting.

30. A method according to claim 29 wherein said foraminous element is a metal mesh.

31. A method according to claim 28 wherein said foraminous element is composed of an electrically insulating material.

32. A method of providing a highly conductive layer on a surface of a device which comprises an element composed of a conductive polymer composition, which method comprises (a) flame-spraying, onto the surface of a carrier member, a material which at 25° C. has a resistivity of at most $5\times10^{-2}$ ohm.cm, to form a layer of said material which is at least 1 mil thick; and (b) contacting said flame-sprayed layer, on said carrier member, and a surface of said device which comprises an element composed of a conductive polymer composition, under conditions of heat and pressure, to form a layer of said material which is in electrical contact and in physical contact with said element.

33. A method according to claim 32 wherein said carrier member is a polymeric film.

34. A method according to claim 33 wherein said polymeric film is an electrical insulator.

35. A method according to claim 32 wherein said device comprises an element composed of a conductive polymer composition which exhibits resistivity temperature behavior selected from the group consisting of PTC behavior and NTC behavior.

36. A method according to claim 35 wherein said flame-sprayed layer is contacted with a surface of said device which is at least partly composed of a PTC conductive polymer composition.

37. A method according to claim 36 wherein said surface of the device is provided by a foraminous element and by said PTC conductive polymer composition in interstices of said element.

38. A method according to claim 37 wherein said foraminous element is electrically conducting.

39. A method according to claim 38 wherein said foraminous element is a metal mesh.

40. A method according to claim 39 wherein said foraminous element is composed of an electrically insulating material.

41. A method according to claim 35 wherein said flame-sprayed layer is contacted with a surface of the device which is at least partly provided by an electrically conducting foraminous element.

42. A method according to claim 35 wherein said flame-sprayed layer is contacted with a surface of the device which consists essentially of a conductive polymer composition.

43. A method according to claim 42 wherein said conductive polymer composition is a PTC composition.

* * * * *